US005505271A

United States Patent [19]

Bourner

[11] Patent Number: 5,505,271

[45] Date of Patent: Apr. 9, 1996

[54] POWER TOOLS AND HAMMER MECHANISMS THEREFOR

[75] Inventor: Michael D. Bourner, Bishop Middleham, United Kingdom

[73] Assignee: Black & Decker Inc., Newark, Del.

[21] Appl. No.: 235,448

[22] Filed: Apr. 29, 1994

[30] Foreign Application Priority Data

May 1, 1993 [GB] United Kingdom ..... 9309054

[51] Int. Cl.[6] ..... B25D 11/10

[52] U.S. Cl. ..... 173/48; 173/205

[58] Field of Search ..... 173/47, 48, 205, 173/178

[56] References Cited

U.S. PATENT DOCUMENTS

| | | | |
|---|---|---|---|
| 3,834,468 | 9/1974 | Hettich et al. | 173/48 |
| 3,955,628 | 5/1976 | Grözinger et al. | 173/48 |
| 4,223,744 | 9/1980 | Lovingood | 173/48 |
| 4,567,950 | 2/1986 | Fushiya et al. | 173/48 |
| 5,343,961 | 9/1994 | Ichikawa | 173/48 |

FOREIGN PATENT DOCUMENTS 1427728 1/1969 Germany .

*Primary Examiner*—Scott A. Smith

*Attorney, Agent, or Firm*—Dennis A. Dearing; John D. Del Ponti; Charles E. Yocum

[57] ABSTRACT

A hammer mechanism (200,200') for a power tool comprises a housing (203), a chuck spindle (201) journalled for rotation in the housing and having axial freedom of movement in the housing, a rotary ratchet (204) fixed on the spindle, the ratchet having teeth (207) facing a rear end of the housing, a fixed ratchet (205) rotationally fixed in the housing but having axial freedom of movement in the housing, the fixed ratchet surrounding the spindle and having teeth (207) facing the teeth of the rotary ratchet, and a spring (213) between the fixed ratchet and housing resiliently biasing the fixed ratchet towards the rotary ratchet.

A first cam (208,209) between the fixed and rotary ratchets has two positions. In a first position, the ratchets can engage one another, whereby reciprocal motion is imparted on the spindle on rotation thereof. In a second position the ratchets are prevented from inter-engagement.

A second cam (224) between the fixed ratchet and housing have two positions. In a first position, the fixed ratchet is axially locked and in a second position the fixed ratchet is permitted rearward movement against the spring.

17 Claims, 4 Drawing Sheets

POWER TOOLS AND HAMMER MECHANISMS THEREFOR

BACKGROUND OF THE INVENTION

This invention relates to power tools and particularly to hammer mechanisms for such power tools.

It is known to provide a hammer mechanism for a power tool comprising an axially movable chuck spindle shaft journalled for rotation in a housing, a rotary ratchet fixed on the shaft, a fixed ratchet in the housing and means selectively to keep the ratchets apart or permit them to engage on user pressure on the shaft. When engaged, as well as the rotary motion imposed by a drive for the shaft, a reciprocating action is imposed on the shaft.

Where the power tool is a drill and a chuck mounted on the chuck spindle shaft is fitted with an appropriate tool bit, the reciprocating (hammer) action greatly improves drilling performance in materials such as masonry. However, the reaction of the reciprocation of the shaft is transmitted to the housing and this is felt by a user as undesirable vibration. On the other hand, in very tough materials, cutting performance can be directly related to the pressure imposed on the housing by the user, and so the user has direct control of the performance of the drill.

It is also known to isolate the fixed ratchet from the housing via a spring, so that the reaction of the ratchet is absorbed by the spring. This not only cushions the impact for the user, so that the tool does not exhibit so much vibration, but also the energy of the reaction is stored in the spring and reimparted to the rotary ratchet on return of the spring. In some soft materials the cutting performance is actually improved by the spring because its reaction time is shorter than the inertia of both the tool and user allows.

BRIEF DESCRIPTION OF THE INVENTION

It is an object of the present invention to provide a hammer mechanism which is an improvement of the mechanisms known hitherto.

In accordance with the present invention there is provided a hammer mechanism for a power tool, which mechanism comprises:

a housing having a front and rear end;

a chuck spindle journalled for rotation in the housing, which chuck spindle has axial freedom of movement in the housing;

a rotary ratchet fixed on the spindle, the ratchet having teeth facing a rear end of the housing;

a fixed ratchet rotationally fixed in the housing but having axial freedom of movement in the housing, the fixed ratchet surrounding the spindle and having teeth facing the teeth of the rotary ratchet;

resilient biassing means between said fixed ratchet and housing urging said fixed ratchet towards said rotary ratchet;

first cam means between said fixed and rotary ratchets having two positions, in a first of which, said ratchets engage one another, at least when said spindle is moved towards said rear end of the housing whereby reciprocal motion is imparted on the spindle on rotation thereof, and in a second of which positions said ratchets are prevented from inter-engagement; and, second cam means between said fixed ratchet and housing having two positions, in a first of which positions said fixed ratchet is substantially prevented from rearward movement in the housing and in a second of which positions said fixed ratchet is permitted rearward movement against said biassing means.

Preferably said cam means each comprise a ring surrounding said spindle and each having castellations which, in said second positions, coincide with corresponding facing castellations on said fixed ratchet, whereas in said first positions said castellations inter-digitate.

Preferably at least said castellations of the first cam means have ramped side walls so that mere rotation of the cam rings is sufficient to move between said positions.

Thus a hammer mechanism according to the present invention offers a choice of two hammer modes in the same device so that a power drill fitted with said device has three drilling modes. A first mode is non-hammer, straight rotation of the chuck spindle when said first cam means is in its second position. If the second cam means is also in its second position, then the chuck spindle is free to move against said biassing means, giving the tool a spongy feel.

A second mode is normal hammer mode, where said cam means are both in their first positions whereby the ratchets engage and the fixed ratchet is effectively solid with the housing.

The third mode is where the second cam means is switched to its second position whereupon a spring hammer mode is achieved by virtue of the permitted travel of the fixed ratchet in the housing against said biassing means.

Preferably said resilient biassing means is disposed between said fixed ratchet and said second cam means. In this event, said second cam means may be pressed against an end cap of said housing, said end cap and second cam means having detent means therebetween to releasably retain said second cam means in either of its two positions.

Preferably, operating means serve to actuate both cam means together and in which case said detent means may have at least three positions corresponding to the second and first, the first and second and the first and first, positions of the first and second cam means respectively, and preferably in that order.

The operating means may actuate knobs on each ring, which knobs then extend through slots in the housing.

The detent means may comprise a ball received in said end cap and recesses in said second cam means.

Said fixed ratchet may have legs engaged in slots in the housing serving to rotationally lock said ratchet in the housing and limit axial movement of the ratchet towards said rotary ratchet. Thus, when said second cam means is in said first position, there is preferably provided sufficient clearance between said second cam means and the fixed ratchet to permit axial movement of the second cam memos on rotation thereof and disengagement of said detent means.

Preferably, such a mechanism is capable of substantially complete assembly by insertion of parts from one end of the housing.

The invention also provides a power tool incorporating such a hammer mechanism and preferably further comprises a nose ring rotationally freely positioned in a housing of the power tool and surrounding said mechanism, said operating means comprising a channel in said nose ring.

The invention is further described hereinafter, by way of example only, with reference to the accompanying drawings, which:

DETAILED DESCRIPTION OF AN EMBODIMENT OF THE INVENTION

Figure 1:
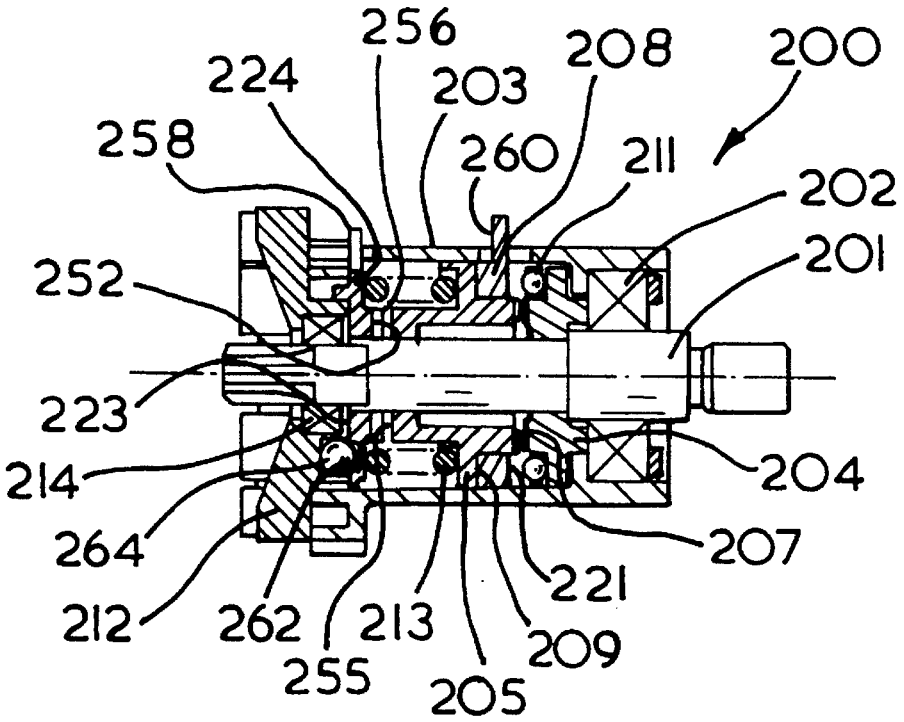
FIG. 1 is a side section through a power tool hammer mechanism according to the present invention.
Figure 2A:
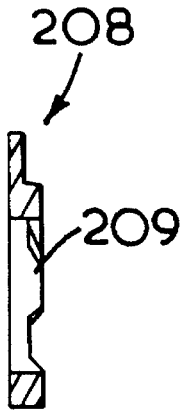
FIGS. 2*a, b* and *c* are a side section, rear view and side view respectively of a first cam ring of the mechanism of FIG. 1.
Figure 2B:
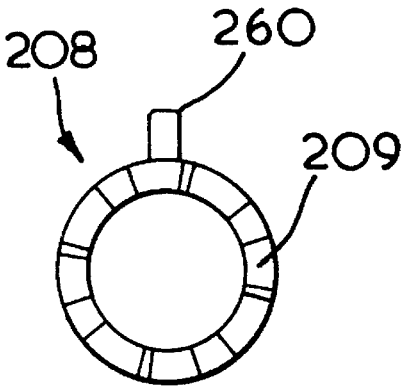
Figure 2C:
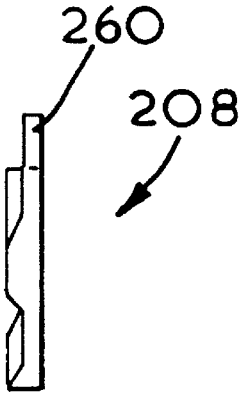

FIG. 1 shows a mechanism 200 which has a housing 203 mounting a drive spindle 201 through a front bearing 202. A rotary ratchet plate 204 is fixed on the drive spindle. A fixed ratchet plate 205 is rotationally fixed but axially freely arranged in the housing 203.

A first externally operable cam ring 208 is disposed between the two plates and serves, when operated, to prise them apart, through the agency of a thrust ring 211.

Figure 3A:
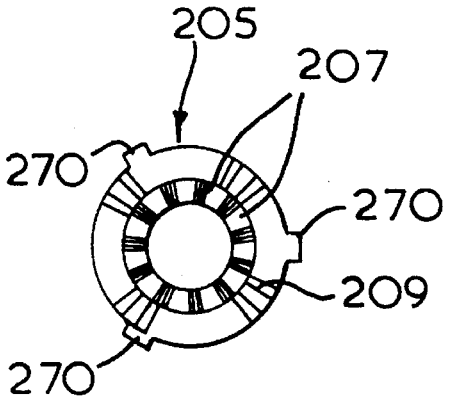
FIGS. 3*a, b* and *c* are a front view, side section and rear view respectively of a fixed ratchet of the mechanism of FIG. 1.
Figure 3B:
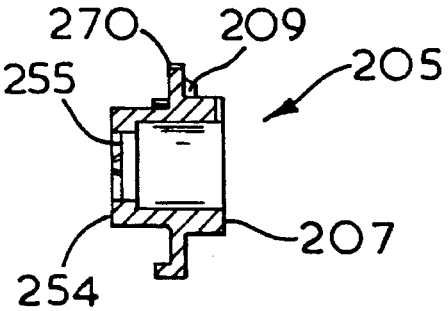
Figure 4B:
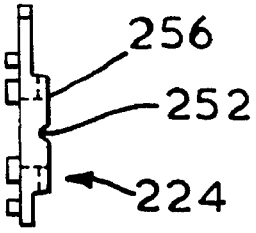
Figure 3C:
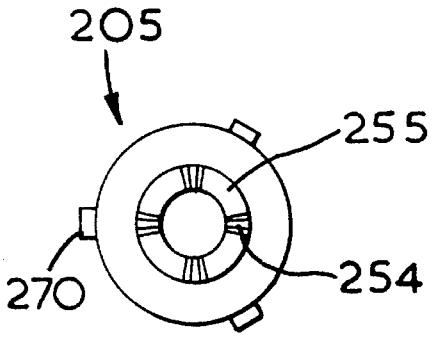

A spring 213 biases the fixed ratchet 205 towards the rotary ratchet 204 so that, when the cam 208 allows it, facing ratchet teeth 207 on the plates 204,205 can engage with one another. However, no hammer effect is experienced until the user applies the tool to a workpiece (neither drawn) and presses the shaft 201 to the left in FIG. 1 and thereby engages the ratchet teeth against the pressure of spring 213. No hammer effect is experienced without user pressure on the spindle 201 because legs 270 (see FIG. 3) of the fixed ratchet 205 engage the end of slots (not shown) formed in the housing 203 and prevent rightward movement of the ratchet 205 beyond the position shown in FIG. 1.

Figure 4A:
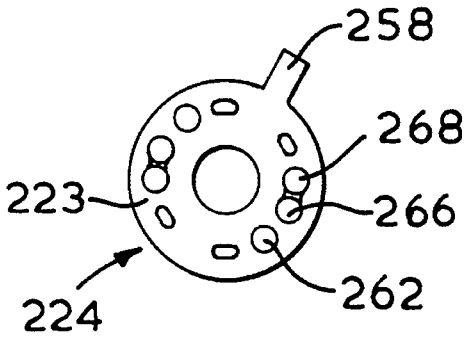
FIGS. 4*a, b* and *c* are a rear view, side view and front view of a second cam ring of the mechanism of FIG. 1.
Figure 4C:
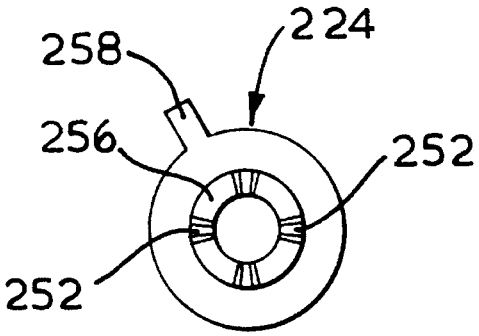
Figure 5:
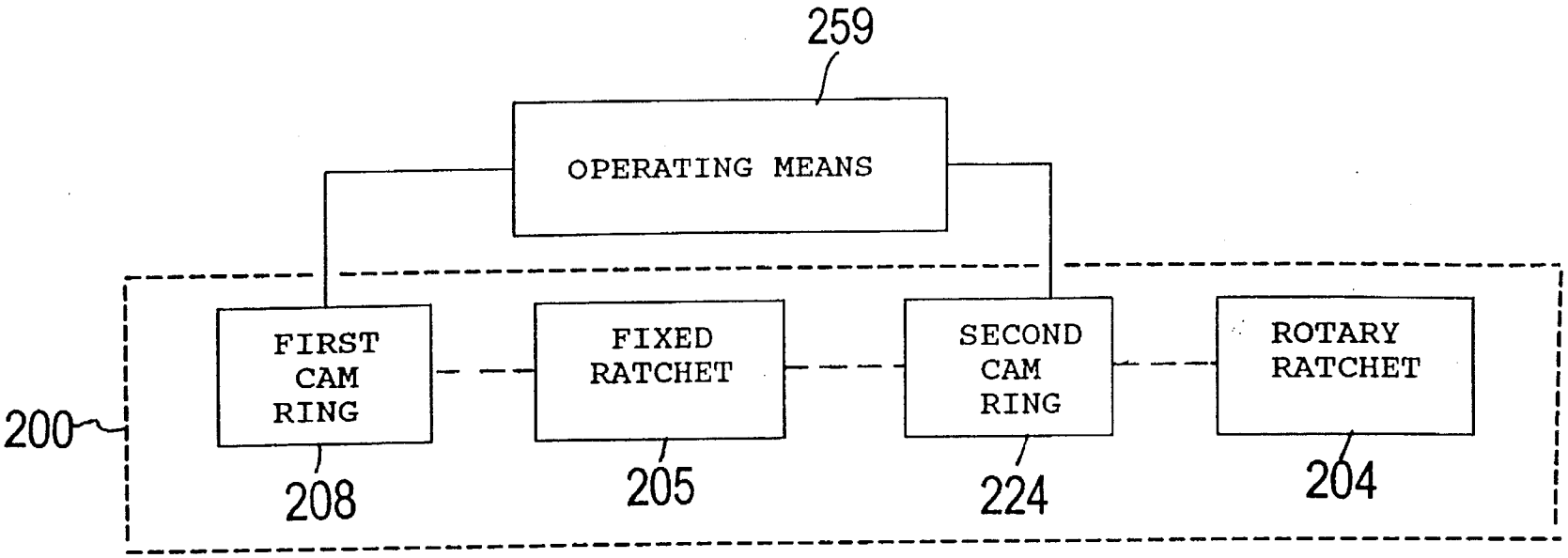
FIG. 5 is a schematic diagram of the hammer mechanism of FIG. 1 showing an operating means for simultaneously operating the first and second cam rings.
Figure 6A:
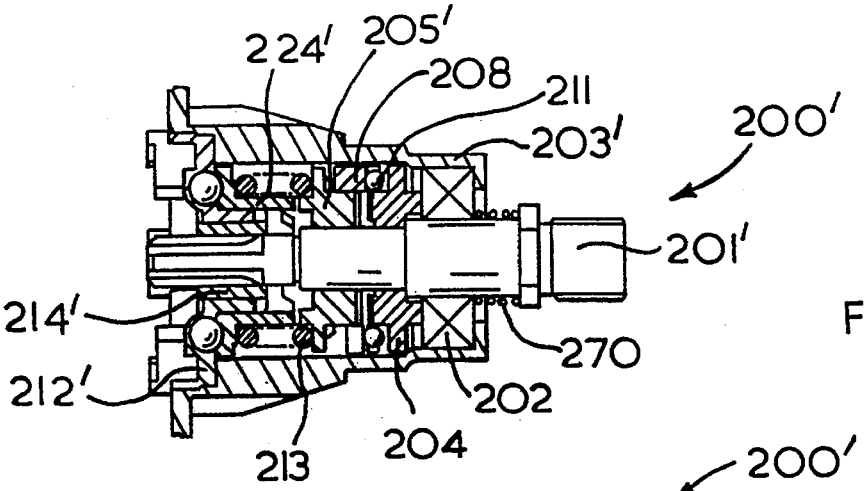
FIGS. 6*a, b, c* and *d* are a diagonal section, a side section, a side view (other side) and a plan view of a different embodiment of a mechanism according to the present invention.
Figure 6B:
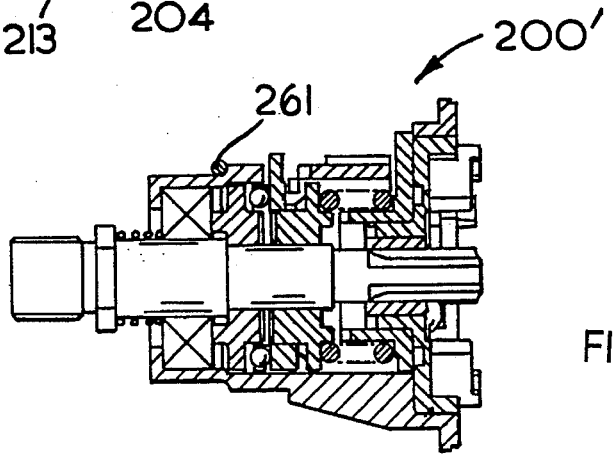
Figure 6C:
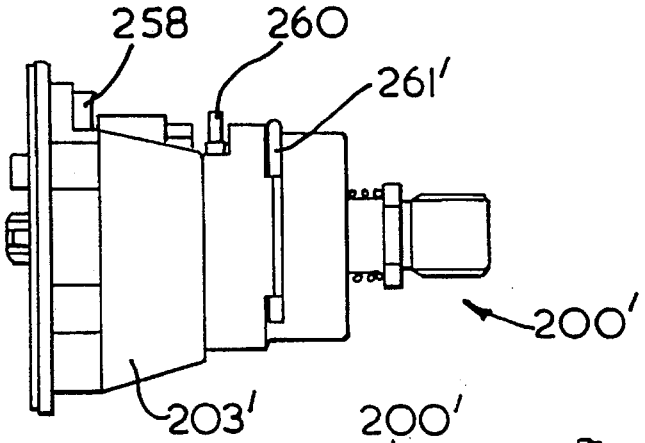
Figure 6D:
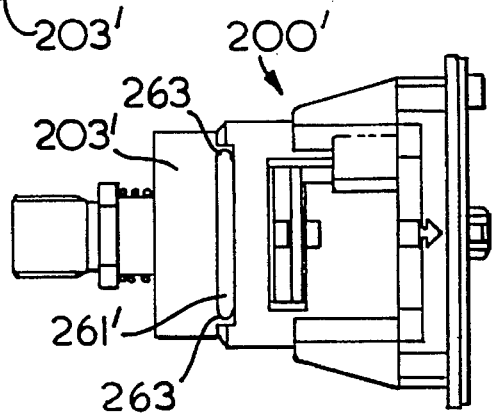

Spring 213 acts against a second externally operable cam ring 224 supported against an end cap 212 of the mechanism 200. The end cap has another bearing 214 also mounting the shaft 201. The second cain ring 224 has a ring of castellations 256 and intervening troughs 252 (see also FIG. 4*c*) around the shaft 201. The fixed ratchet 205 has matching castellations 254 and troughs 255 (see FIG. 3*c*) so that, when the second cam ring 224 is in the correct rotational position (as shown in FIG. 1), then the castellations 254 can engage the troughs 252, and vice versa, so that the fixed ratchet has a full rearward stroke length within which to compress the spring 213. The user can, however, apply sufficient weight/force to the housing 203 so that the shaft 201 is pressed leftwardly in FIG. 1 taking with it the rotary ratchet 204 and fixed ratchet 205 (with the cam ring 208 and thrust ring 211 carried between them) until the castellations 254 hit the bottom of the troughs 252 and vice versa.

However, this arrangement can be locked without the need to apply the requisite force to compress spring 213. This is achieved by turning the second cain ring 224 in housing 203 so that castellations 256 on the cam ring are aligned with castellations 254 on the ratchet. Then, the fixed ratchet 205 can only move leftward sufficiently to just begin compressing spring 213 before it becomes a solid link to the housing 203.

Thus the two cam rings, the ring 208 and ring 224 require user actuation between three positions. Each ring has a knob 260 and 258 respectively extending through the housing 203 which each could be joined together for simultaneous operation by an operating means 259 (FIG. 6) such as a single slide switch or lever. Alternatively, when incorporated in a power tool, the mechanism 200 may protrude from an opening in the housing of the power tool and in which event, the operating means 259 may be constituted by a nose ring. The nose ring surrounds the mechanism 200 and has a channel engaging both knobs 260,258. The nose ring is arranged rotational in the housing of the power tool so that turning the nose ring serves to operate the knobs 258,260.

In a second position of the combined movement of cam rings 208,224, hammer mode is deselected. Thus the ratchet teeth 207 are separated by a first cam means 209 between the cam ring 208 and fixed ratchet 205. This is achieved by the cams 209 moving the cam ring 208 rightwardly in FIG. 1 until a front surface 221 thereof is contacted by the balls on the thrust ring 211, rather than the ratchet teeth 207 engaging each other. Thus no reciprocation is imparted on the shaft, and smooth rotation is transmitted by the mechanism 200. Moreover, in non-hammer mode a rigid connection between the tool and housing is normally required. If the spring 213 was compressed as pressure was applied to the shaft 201, the drill would have a spongy feel. Consequently, in this mode, the castellations 254,256 should normally be aligned.

On joint rotation of the rings 208,224 a recess 262 in a rear face 223 of the ring 224 (and which recess 262 presently engages a ball 264 held in the end cap 212) snaps out of engagement with that ball against spring pressure from the spring 213. A small clearance between teeth 254,256 is necessary to allow this movement (rightwards) of the ring 224. After a small angle of rotation, a second recess 266 (see FIG. 4*a*) snaps into engagement with the ball 264. In this position, the cam arrangement 209 is released returning the ting 208 to a first combined position, as shown in FIG. 1 where leftward movement of the shaft 201 brings the rotary ratchet 204 into engagement with the fixed ratchet 205 and engaging the teeth 207. The ring 208 and thrust ring 211 here fail to keep the teeth apart.

Depending on requirements, this first position could be a fixed hammer mode, in which the castellations 256,254 are still aligned with each other. Thus when the shaft 201 and rotary ratchet 204 do move back and begin to compress spring 213, it is only a short distance before clearance of the teeth 256,254 is bridged and the fixed ratchet can no longer move backwards.

On further rotation of the first and second cam rings 208,224 the ball 264 snaps out of engagement with recess 266 and falls quickly into further recess 268. This rotation to a third position of the cam rings 208,224 has no effect on the ratchet plates 204,205 which still engage each other in hammer mode, but it is sufficient to bring castellations 254 and 256 respectively into alignment with troughs 252 and 255 on the fixed ratchet and second cam ring. Thus now, instead of providing a stop, the second cam ring 224 allows the fixed ratchet plate 205 to travel leftwards with increasing user pressure on the housing 203 and progressively compressing the spring 213. Instead of acting directly on the housing 203, the reaction of the ratchet mechanism 207 is, on the one hand, absorbed by the spring 213 and, on the other hand, is bounced back to hammer more effectively the shaft 201.

Turning now to FIG. 6, a preferred embodiment is shown which differs only in minor detail from that shown in FIGS. 1 to 5.

In this embodiment, it is the second cam ring 224' which extends forwardly, rather than the fixed ratchet 205' extending rearwardly as in the first embodiment, both to span the length of spring 213.

Also, the bearing 202 is here inserted from the rear of the housing 203', it being retained by a spring stirrup 261', rather than a circlip 261 as in the first embodiment. The stirrup 261' passes through apertures 263 in the housing 203'. Here, a spring 270 urges the spindle 201' out of the housing 203' to keep the ratchets 204,205' apart until user pressure is applied to bring them together, assuming the first cam ring 208 permits it.

Finally, bearing 214 of the first embodiment is replaced by a bearing bush 214' in a modified end cap 212'.

The main advantage of the second embodiment over the first is that assembly is facilitated. First, the spindle 201' is assembled, by positioning spring 270 and bearing 202 on the shaft before pressing the rotary ratchet 204 onto the shaft. This then becomes a pre-assembled unit. Next, the whole mechanism 200' is assembled by inserting the following components one after another into the housing 203', all from the same end so that automatic assembly is facilitated: First, the pre-assembled drive spindle 201' and bearing; then the thrust bearing 211 followed by first cam ring 208, fixed ratchet 205', spring 213, second cam ring 224' and finally end cap 212'. Clip 261' is then inserted to retain the bearing 202 in position.

I claim:

1. A hammer mechanism for a power tool, which mechanism comprises:

a housing;

a chuck spindle journalled for rotation in the housing, which chuck spindle has axial freedom of movement in the housing;

a rotary ratchet fixed on said chuck spindle, the ratchet having teeth which face a rear end of the housing;

a fixed ratchet rotationally fixed in the housing but having axial freedom of movement therewithin, the fixed ratchet surrounding the spindle and having teeth facing said teeth of the rotary ratchet;

resilient biasing means between said fixed ratchet and said housing urging said fixed ratchet towards said rotary ratchet;

a first cam means between said fixed and rotary ratchets, the first cam means having two positions, in a first of which, said fixed and rotary ratchets engage one another, at least when said spindle is moved towards said rear end of the housing whereby the spindle is reciprocally driven when the spindle is rotated, and in a second of which positions said fixed and rotary ratchets are prevented from inter-engagement with each other; and, a second cam means between said fixed ratchet and said housing, the second cam means having two positions, in a first of which positions said fixed ratchet is substantially prevented from rearward movement in the housing and in a second of which positions said fixed ratchet is permitted rearward movement against said biasing means.

2. A mechanism as claimed in claim 1, in which said resilient biassing means is disposed between said fixed ratchet and said second cam means.

3. A mechanism as claimed in claim 2, in which said second cam means is pressed against an end cap of said housing, said end cap and second cam means having detent means therebetween to releasably retain said second cam means in either of its two positions.

4. A mechanism as claimed in claim 3, in which operating means serve to actuate both first and second cam means together and in which said detent means have three positions corresponding, respectively, to three operating modes formed by (a) the second and first, (b) the first and second and (c) the first and first positions of the first and second cam means respectively.

5. A mechanism as claimed in claim 4, in which said operating means actuate said first and second cam means in the order of the modes specified in claim 4.

6. The mechanism of claim 4 wherein:

the first and second cam rings have first and second knobs, respectively, extending through slots in the housing; and the operating means actuates the first and second knobs.

7. A mechanism as claimed in claim 3, in which said detent means comprise a ball received in said end cap and recess in said second cam means.

8. A mechanism as claimed in claim 7, in which, when said second cam means is in said first position, there is sufficient clearance between said second cam means and the fixed ratchet to permit axial movement of the second cam means for disengaging the detent means when the second cam means is rotated.

9. A mechanism as claimed in claim 1 which is capable of substantially complete assembly by insertion of parts from one end of the housing.

10. The mechanism of claim 1 wherein:

the first and second cam means comprises first and second cam rings, respectively, that surround the spindle;

the fixed ratchet has first and second sets of ratchet castellations on opposed faces, respectively; and the first and second cam means each having castellations (a) in the second positions of the first and second cam means coinciding with the first and second set of ratchet castellations, respectively, and (b) in the first positions of the first and second cam means interdigitating with the first and second sets of ratchet castellations, respectively.

11. A mechanism as claimed in claim 10, wherein said castellations of the first cam means have ramped side walls so that mere rotation of the first and second cam rings is sufficient to move said first cam means between said first and second positions.

12. A mechanism as claimed in claim 11, in which said resilient biassing means is disposed between said fixed ratchet and said second cam means.

13. A mechanism as claimed in claim 12, in which said second cam means is pressed against an end cap of said housing, said end cap and second cam means having detent means therebetween to releasably retain said second cam means in either of its two positions.

14. A mechanism as claimed in claim 13, in which operating means serve to actuate both the first and second cam means together and in which said detent means have three positions corresponding, respectively, to three operating modes formed by (a) the second and first, (b) the first and second and (c) the first and first positions of the first and second cam means respectively.

15. A mechanism as claimed in claim 10, in which said resilient biassing means is disposed between said fixed ratchet and said second cam means.

16. A mechanism as claimed in claim 15, in which said second cam means is pressed against an end cap of said housing, said end cap and second cam means having detent means therebetween to releasably retain said second cam means in either of its two positions.

17. A mechanism as claimed in claim 16, in which operating means serve to actuate both the first and second cam means together and in which said detent means have three positions corresponding, respectively, to three operating modes formed by (a) the second and first, (b) the first and second and (c) the first and first positions of the first and second cam means respectively.

* * * * *